US006799729B1

(12) United States Patent
Voic

(10) Patent No.: US 6,799,729 B1
(45) Date of Patent: Oct. 5, 2004

(54) ULTRASONIC CLEANING AND ATOMIZING PROBE

(75) Inventor: Dan Voic, Clifton, NJ (US)

(73) Assignee: Misonix Incorporated, Farmingdale, NY (US)

( * ) Notice: Subject to any disclaimer, the term of this patent is extended or adjusted under 35 U.S.C. 154(b) by 336 days.

(21) Appl. No.: 09/393,256

(22) Filed: Sep. 10, 1999

Related U.S. Application Data

(60) Provisional application No. 60/099,832, filed on Sep. 11, 1998.

(51) Int. Cl.[7] ..... D05B 1/08
(52) U.S. Cl. ..... 239/102.2; 239/104
(58) Field of Search ..... 239/102.1, 102.2, 239/103, 104, 106, 110, 119

(56) References Cited

U.S. PATENT DOCUMENTS 3,243,122 A * 3/1966 Snaper
3,292,910 A * 12/1966 Martner
4,844,343 A * 7/1989 Kurokawa et al.
5,070,881 A * 12/1991 Weiland
5,371,429 A * 12/1994 Manna ..... 160/85

* cited by examiner

*Primary Examiner*—Christopher Kim
(74) *Attorney, Agent, or Firm*—R. Neil Sudol; Henry D. Coleman; William J. Sapone

(57) ABSTRACT

An ultrasonically excitable tool or probe is provided with a central bore, and a coupling for attachment to an ultrasonic transducer also provided with a central bore. Fluid may be injected along the communicating bores for filling a bowl or concavity on a distal end of the tool. Upon energization of the transducer, fluid in the concavity serves as a conventional ultrasonic cleaning bath for depending parts which the tool may be raised to accommodate in the concavity. This cleaning may be achieved in a confined space where the presence of the transducer is impossible or impermissible, which is further facilitated by the existence of an extended handle or shaft portion, containing the bore, on the ultrasonic tool. A particular shape of the concavity is found to have unexpected utility in creating and focussing an atomized spray.

21 Claims, 2 Drawing Sheets

ULTRASONIC CLEANING AND ATOMIZING PROBE

CROSS-REFERENCE TO A RELATED APPLICATION

This application relies for priority purposes on U.S. provisional application No. 60/099,832 filed Sep. 11, 1998.

FIELD OF THE INVENTION

This invention relates to a method of cleaning and an associated device. In particular, this invention is related to the general field of ultrasonic cleaning. The invention is especially useful in cleaning dirt and oxides from electrical contacts. This invention is also related to the field of atomizing or spraying a liquid, and in particular ultrasonic atomization or spraying.

BACKGROUND

Ultrasonic devices have been utilized for several decades for such applications such as cleaning of precision instruments, atomization of liquids, disruption of biological material and bloodless removal of tissue in surgical procedures. Most of these devices have utilized a transducer constructed using one of three designs. In one design, a piezoelectric crystal resonator is bonded to the bottom of a metal dish or tray. In a second design, a transducer is manufactured from two or more crystal resonators sandwiched between a front and rear mass (known as a Langevin sandwich transducer). In a third design, a coil of wire is wound around a laminated nickel core, known as a magnetostrictive transducer. The manufacturing and operating principles of these devices are well-documented in prior art and engineering texts.

One characteristic of the transducer type device is that the minimum length is limited by the wavelength of a sound wave at the frequency of operation. The minimum length is roughly equal to a half-wavelength at the natural resonant frequency of operation. For a device operating at low ultrasound frequency, such as 20,000 Hz, this length is approximately 5.5 inches if titanium or aluminum is used as the material of the resonator. As the frequency of operation is increased, this length may be shorter, since the sound wavelength is inversely proportional to the resonant frequency. Although the device will resonate at the desired frequency and deliver significant power to the load, the transducer size limits the application of the device in situations where space is at a premium Crystal resonators are significantly shorter than a Langevin sandwich transducer since the thickness or diameter of the resonator crystal sets the operating frequency of the system as front and rear masses are not used. However, the operating frequency is usually much higher than that of the Langevin sandwich units, generally greater than 40,000 Hz. A significant drawback of this type of construction is that the power and amplitude output of the device is severely limited by the mechanical properties of the crystal. The power and amplitude output of a crystal resonator may in fact be an order of magnitude less than that possible with the sandwich type units. Another factor in the use of the crystal resonator type of ultrasonic transducer device that electrical connections are needed on each face of the crystal faces, making isolation and sealing of the system difficult in some circumstances.

An application for ultrasonic cleaning exists in the manufacture of special integrated circuit assemblies. A device is needed to clean dirt and oxide deposits from the bottom of a printed circuit card having attached metal connector prongs or electrical contacts. This circuit card is mounted in a large automated testing machine, which makes the removal and cleaning of the card difficult. As dirt and oxides build up, the metal contacts do not make positive electrical connection with integrated circuits under test, and unreliable test results may be obtained. To maintain reliability the automated tester must be periodically removed from service and cleaned, at a significant cost in downtime and labor.

Experimentation has shown that a high power ultrasound bath is useful in removing the dirt and oxide deposits from the tester contacts. However, the automated tester does not allow for the mounting of a conventional bath type cleaner below the circuit card due to severe space constraints. In addition, high voltage must be avoided in the vicinity of the circuit card contacts in order to prevent electrical damage to the tester and associated circuits, and it is further undesirable to have liquid present in the vicinity of electronic devices under test. It is, therefore, an open question based on the prior art whether ultrasonic cleaning can be applied here.

In a further application of ultrasonic vibration, in addition to cavitation induced cleaning, it is found that ultrasonic energy injected into a fluid under some conditions may lead to rapid atomization, or conversion of the fluid into a mist or spray of small droplets. This phenomenon finds application, for example, in ultrasonic room humidifiers, which are able to thereby vastly increase the surface area of a volume of water, promoting evaporation. Spray formation, however, is generally broadcast, producing spray or droplets in an expanding cone. In some applications, it would be useful to have a tightly controlled spray, concentrated or focused to a small area, for example, in a local application of a liquid to a surface, or a localized cleaning operation.

OBJECTS OF THE INVENTION

An object of the present invention is to provide an ultrasonic type cleaning device and/or an associated method.

It is another object of the present invention to provide such a method and/or device which facilitates rigorous surface cleaning in locations with restricted access.

It is a more particular object of this invention to provide a method and/or device facilitating cleaning of overhead surfaces in locations with restricted access.

Still a further object of the invention is to provide a method and/or cleaning device to clean electronic contacts without conducting potentially damaging voltages to a vicinity about the electrical contacts.

Another object of the invention is to provide a method and/or device for atomizing liquids into a mist or spray, which focusses the spray into a small area.

These and other objects of the invention will become clear by a study of the description and drawings contained herein.

BRIEF DESCRIPTION OF THE INVENTION

A cleaning device in accordance with the present invention possesses an extension which may be inserted into a confined area. The extension or probe is excitable in ultrasonic vibration via an attached transducer which may be disposed in an adjacent and more accessible area. The probe has no electrical connections, and essentially constitutes a passive mechanical tool. The probe may be provided with a channel extending to a cavity or recess at a distal end for filling the concavity or recess with fluid.

In particular, the instant ultrasonic cleaning device may be at least partially installed in a confined area below a circuit card of an automated tester, so that during a cleaning operation an associated probe or tool may be brought into contact with a bottom of the circuit card, filled with liquid, and excited in ultrasonic vibration in order to remove oxide and dirt buildup on the contacts of the card by ultrasonic cavitation. Following completion of the cleaning operation, the probe or tool allows the liquid to be drained from the area of the card until such time as the operation must be repeated. Such a device does not require the introduction of electrical contacts or voltages to the confined area during the cleaning operation.

The invention essentially comprises a self-filling ultrasonically excitable spoon.

Considered in abstract, spoons may be characterized by presence of an elongate handle attached at one end to a bowl-shaped or spatulate concavity for containing an aliquot of a liquid. A general embodiment of the present invention comprises a tool embodying these characteristics and further provided with a connector for coupling to a transducer excitable in ultrasonic vibration.

In parallel to comprehension as a modified use of a traditional tool shape, the invention may also be understood in the context of the ultrasonic art. It is known to produce tools of various shapes interchangeably couplable to an ultrasonic transducer. The present invention comprises such a tool in the form of a spoon. Accordingly, the present invention may be understood as an application of an ancient tool shape to a modem process.

The aboriginal spoon fulfils two design objectives: ability to manipulate a portion of liquid from a distance, and ability to manipulate a portion of liquid in a confined space with restricted access. The former characteristic permits handling of liquids without contacting the user's fingers, while the latter finds utility in inserting a portion of a liquid into the mouth.

Manipulation of a fluid supporting concavity from a distance and in regions of limited access finds utility also in the present invention. Here, however, instead of primarily protecting the manipulator from the environs of the bowl, such as hot soup, the environs of the bowl are protected from the manipulator; in particular, electrical circuit contacts are protected from high electrical voltages associated with an ultrasonic transducer. The principle of isolating sensitive devices from harsh environmental factors by means of a mechanical extension remains operative, whether fingers from hot soup, or sensitive electrical contacts from high voltage.

Other features serve to further distinguish the present invention from the prior spatulate art: ultrasonic excitation and self-filling of the concavity. The traditional spoon is passive and does not suggest connection to an electrical or mechanical power source, nor the provision of internal channels for filling of the bowl. The present invention, however, couples a source of ultrasonic vibration to a handle of a spatulate tool and in one embodiment optionally provides the tool with a channel or bore in the handle for filling the bowl or concavity with fluid.

An ultrasonic probe in accordance with the present invention mounts to the output end of an ultrasonic transducer by means of threads or other attachments known to the art. The probe is dimensioned to vibrate at approximately the same resonant frequency as the transducer itself. To achieve this resonant frequency in the probe, the probe can be one or more half-wavelengths of the wavelength of sound in the material of the probe at the resonant frequency of the transducer.

The distal end of the probe of the present invention is machined asymmetrically about a major, longitudinal, axis of the probe. The width of the distal end or bowl portion of the probe may be of any size needed to cover the area which needs to be cleaned. Thickness, including depth of a bowl or concave recess, is dictated by the available space for installation, as well as the extension of any protruding contacts. Although a round or bowl shaped configuration of the distal end of the probe is preferred, other geometric shapes may be chosen if needed.

Into one face of the distal end or the probe or tool is machined a concave recess with a roughly parabolic cross section. It is believed that the parabolic cross section is instrumental in a focussing of ultrasonically atomized mist or spray, which is described in greater detail below. The bottom of the concavity is offset from the major axis of the probe. A bore is fashioned by drilling along the centerline or axis of the probe from the proximal and thereof until the bore exits into the concavity machined at the distal end. This bore communicates with a lumen or channel provided in a hollow transducer coupled to the probe. By connecting the proximal end of the transducer to a liquid source, liquid may be pumped through the transducer, along the axis of the probe and finally into the concavity by little pressure. The concavity may be filled to the brim or allowed to overflow as the application permits. An elastomeric seal may be fashioned around the rim of the concavity to allow sealing of the liquid therein against the circuit card or part being cleaned.

To drain the liquid from the concavity of the probe, the transducer channel may be placed under suction to draw the liquid back through the bore in the probe. Alternatively, the probe bore may be extended all the way to the distal end so that a drain port is formed on a side of the concavity opposite the handle and the transducer. By opening a valve, the liquid may be simply drained without flowing through the transducer again.

In practice, the probe is mounted below the surface to be cleaned, with the longitudinal axis roughly parallel to the circuit card. It can be appreciated by those schooled in the art that the clearance below the board need only be slightly greater than the thickness of the probe itself while the length of the assembly can be as great as needed in order to reach the area to be cleaned.

Once the transducer is activated, the probe will vibrate longitudinally. Typical amplitudes at the distal end could be as high as 100 $\mu$m peak to peak. The vibrations of the walls or surfaces of the concavity are then imparted to the liquid contained therein. Cavitation is induced in the fluid in the same manner as in commercially available ultrasonic cleaners. The cavitation bubbles clean contacts of the circuit card when the bubbles implode upon the contacts. The frequency of operation may be chosen to provide the best compromise between bubble size and cavitation intensity. After cleaning has been accomplished, the liquid may be drained and fresh liquid brought into the cavity as previously discussed above.

A secondary mode of operation of ultrasonic probes in accordance with the present invention is contemplated. It is well known that ultrasonic energy can cause atomization of a working fluid i.e., the production of a mist or spray from the working fluid. Moreover, it is found or known that focussing of the spray or mist may confer additional utility in certain applications of ultrasonic atomization. Particular configurations or embodiments of the instant ultrasonic tool or probe 50, 50' show special and unexpected utility for atomization.

As those schooled in the art will appreciate, the atomizer may be operated either in a continuous flow mode by pumping liquid into the bowl via the central bore or by filling the bowl with a finite volume of liquid and energizing the probe with ultrasonic pressure waves. This mode of operation may be useful in nebulizing specific doses of medicine for inhalation therapy.

A device in accordance with the present invention allows an ultrasonic bath to be installed in areas of limited access, with no electrical connections in the vicinity of the part to be cleaned, which can be filled and emptied remotely. In addition, by changing some basic parameters of operation the same device may be converted from a simple cleaner to an atomizer with special properties.

DETAILED DESCRIPTION OF THE INVENTION

Figure 1:
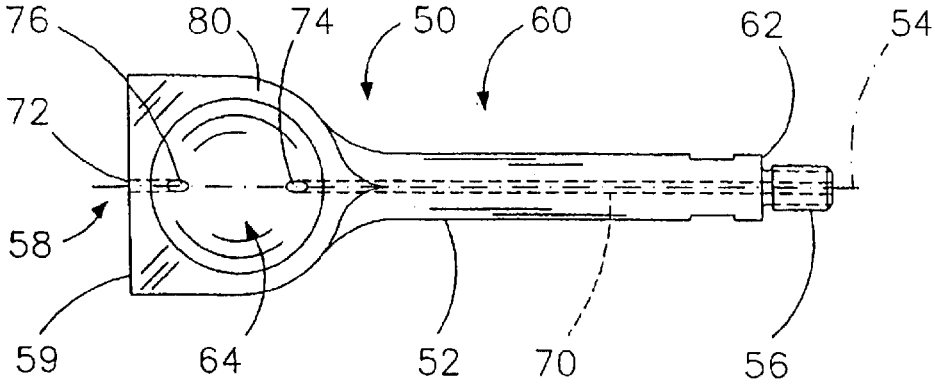
FIG. 1 is a plan view of an ultrasonic tool in accordance with the present invention.

As illustrated in FIG. 1, a proximal segment 60 of a probe or tool 50 comprises a shaft 52 which may be circular, triangular or rectangular, or some other shape in cross section, and which possesses an optional degree of symmetry about a longitudinal major axis 54. Shaft 52 is terminated at a proximal end 62 with a thread 56 for attachment to an ultrasonic transducer (not shown), as is currently known to the art. Shaft portion 52 is at least one quarter wavelength in length, for the intended resonant frequency of operation.

Figure 2:
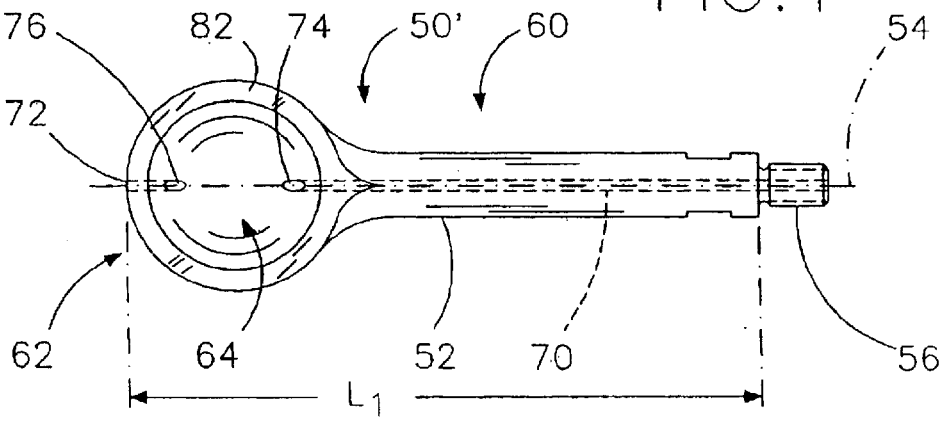
FIG. 2 is a plan view of an alternative embodiment of the tool of FIG. 1.
Figure 3:
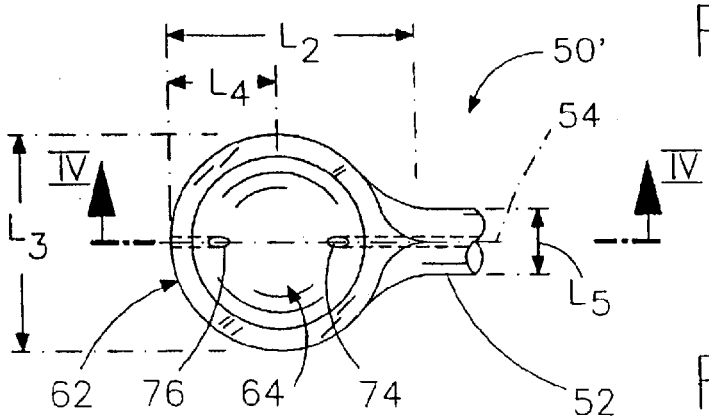
FIG. 3 is a detail of FIG. 2, on the same scale, showing length parameters.
Figure 4:
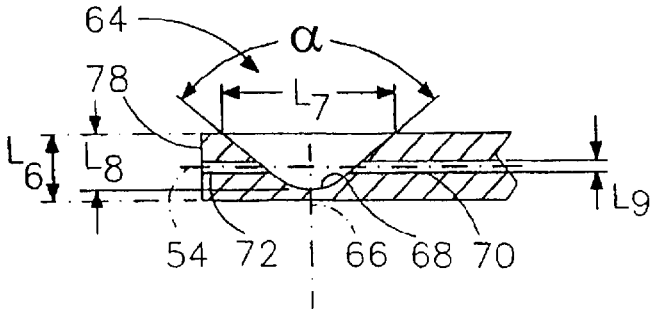
FIG. 4 is a cross-sectional view taken along line IV—IV in FIG. 3, showing further geometric parameters.

A distal segment 58 of probe 50 flares out in at least one dimension in order to provide sufficient area to clean an intended component part or assembly. Distal segment 58 is finished in either a truncated section or planar end face 59, as shown in FIG. 1, or a circular fashion, as illustrated for an alternate tool 50' with a distal segment 62 in FIG. 2. Probe 50, 50' may be manufactured from a single piece of metal, such as aluminum or titanium, or may be a composite piece in which different materials (not illustrated) are used for the proximal and distal ends. Those schooled in the art will realize that dimensions $L_1$, $L_2$, $L_3$, $L_4$, $L_5$ in FIG. 3 and $L_6$, $L_7$, $L_8$, $L_9$, and angle $\alpha$ in FIG. 4 must be adjusted to allow the probe to have a natural half wave resonance at the desired operating frequency.

On one side of flared distal section 58, a recess or open container in the form of a bowl or concavity 64 of roughly parabolic cross-section is formed by machining. Bowl 64 generally possesses a rotational degree of symmetry about axis 66 (FIG. 4) and hence has approximately the shape of a paraboloid characterized by exit width $L_7$, exit angle $\alpha$, and depth $L_8$. A bottom surface 68 of the bowl or concavity 64 lies at or below the centerline or longitudinal major axis 54 of probe 50 or 50', as determined by dimension $L_8$.

A bore (not separately designated) is machined through probe 50 or 50' along major axis or centerline 54. The bore forms a channel comprising a proximal bore segment 70 and a coaxially disposed distal bore segment 72. Proximal bore segment 70 intersects bowl 64 at a first port or opening 74, while distal bore segment 72 intersects bowl 64 at a second port of opening 76, since surface 68 of the bowl 64 lies below the centerline or axis 54 of probe 50, 50'. This configuration allows a liquid channel or bore 92' (FIG. 5) in an ultrasonic transducer assembly 90 to communicate with bowl 64. Distal bore segment 72 is optional and may be included if a drain or additional fill port is desired. Distal bore segment 72 and proximal bore segment 70 are formed in the same drilling operation by extending bore segment 70 distally to intersect an opposite side wall (not separately designated) of bowl 64 and finally pierce a distal surface 59 (FIG. 1) or 78 (FIG. 4) of probe 50, 51'. Alternatively a second bore or bore segment may be machined at any angle with respect to the center line or longitudinal axis 54, such as 90 degrees, to allow an auxiliary port (not illustrated) to come in from the side. Also, a bore or bore segment may be machined through bottom surface 68 of bowl 64 to form a bottom drain or fill.

Figure 5:
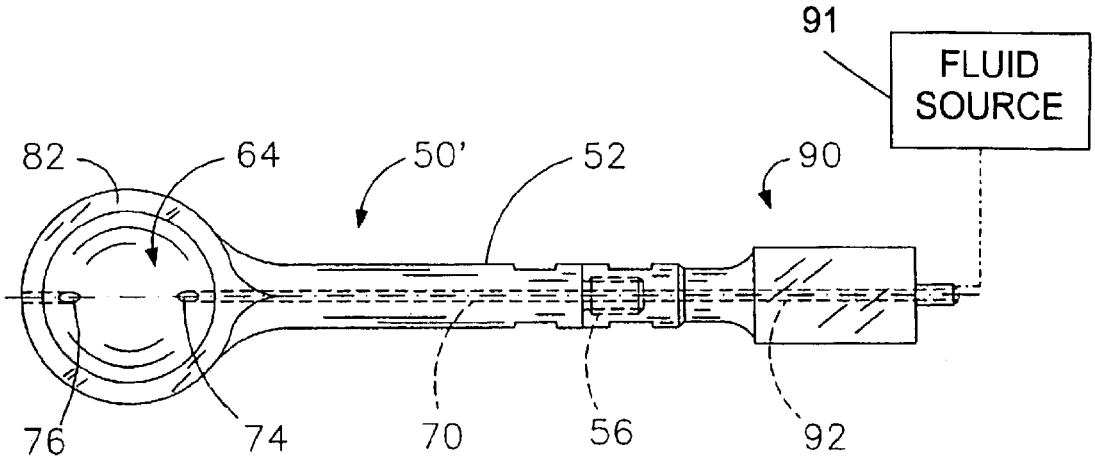
FIG. 5 is a plan view of the tool of FIG. 2 with an ultrasonic transducer attached.

FIG. 5 depicts probe 50 mounted to typical piezoelectric transducer assembly 90. Center bore 92 of transducer assembly 90 communicates with proximal probe bore segment 70 to allow liquid from a fluid source 91 to be pumped to bowl or concavity 64 through port 74. Additional port 76 may be plugged or attached to flexible tubing (not shown) to allow bowl 64 to be filled without going through transducer bore 92, if, for example, a hollow transducer 90 is not available, or to allow draining of the bowl or cavity via a remote valve (not shown). Flexible tubing should be used in order to prevent the probe from being detuned or dampened unnecessarily.

In operation, flat 80 or 82 of tools or probes 50 and 50' respectively are moved into contact with an underside of a workpiece or cleaning target 92 (FIG. 6), on which, for example, may be mounted a circuit card 94 from a lower side of which depend electrical contacts 96, 98, which are to be cleaned by ultrasonic cavitation. As shown further in FIG. 6, an optional elastomeric layer or gasket 100 may be provided along an upper side of probe 50, 51 ' in order to effect a seal between tool surface 82 and circuit card or substrate 94. Fluid (not illustrated) may then be pumped or blown through bore segment 70 into bowl 64, whereupon transducer 90 is activated to generate an ultrasonic resonant wave form in probe 50, 50' and an ultrasonic cleaning operation is effected. Following the cleaning operation, transducer 90 is de-energized, and fluid remaining in bowl 64 is either sucked back through bore segment 70, or blown or drained through additional bore segment 72. At approximately the same time, probe or tool 50 or 50' is withdrawn from an underside of workpiece 92 from which may depend circuit card 94 with contacts 96, 98, and a normal operation of a testing machine of which card 94 may form a component may be recommenced.

In addition to use as a cavitation-medicated cleaner, probe 50,50' may be used in atomization of a liquid. As the amplitude of vibration of the probe 50,50' is increased, liquid contained in bowl 64 begins to atomize. As the amplitude is increased further, the atomized fluid begins to converge to a point above the bowl. In other words, the spray is focused. This operating mode may have beneficial applications where liquid must be atomized and deposited in a specific location. Further testing has demonstrated a relationship between amplitude of vibration and liquid level within the concavity which is outlined in matrix form in Table I:

TABLE I

| | | Amplitude | | |
|---|---|---|---|---|
| | | Low | Medium | High |
| Liquid Level | Low | Atomized | Atomized | Atomized |
| | Medium | Bath | Atomized | Atomized |
| | High | Bath | Bath | Bath |

As the amplitude of vibration increases, there is a greater tendency toward atomization. As the liquid level is increased, the unit shows a greater tendency toward acting as a conventional ultrasonic bath. This characteristic may be useful in tailoring the probe 50,50' to a specific purpose.

Figure 7:
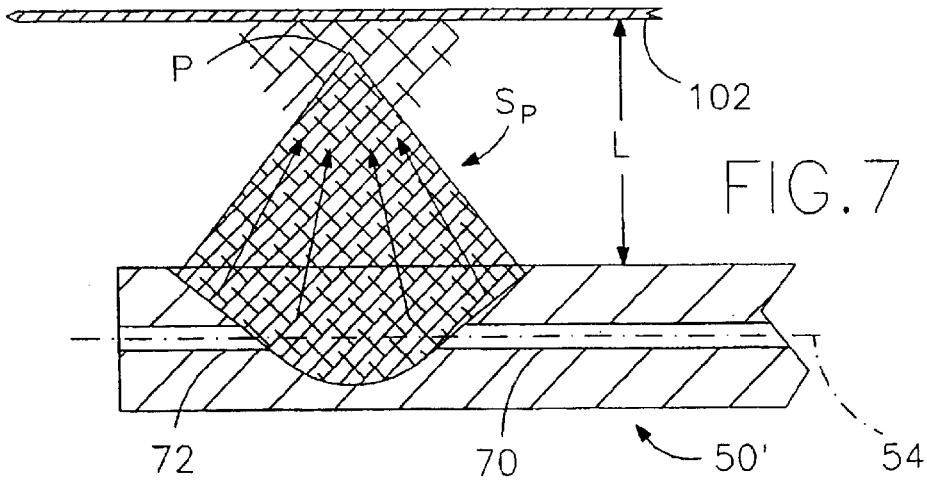
FIG. 7 is partially a cross-sectional view of the detail of FIG. 3 of the tool of FIG. 2, on an enlarged scale, and partially a schematic diagram of a focussed spray produced by the tool.

Particular configurations or embodiments of the instant ultrasonic tool or probe 50, 50' show special and unexpected utility for atomization, in particular, those embodiments employing a parabaloid bowl 64, as illustrated in FIG. 7. Bowl or concavity 64 has a generally parabolic cross section and a paraboloid, or rotated parabola shape. This shape has proven to provide an optimal focusing action for a spray generated upon sufficiently high-frequency ultrasonic energization.

Figure 6:
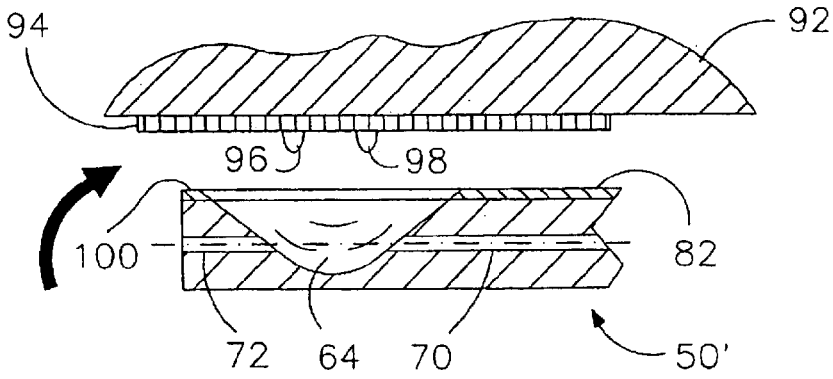
FIG. 6 is partially a cross-sectional view of the detail of FIG. 3, and partially a cross-sectional view of a work piece.

In this secondary mode of operation, tool or probe 50' is held at a stand-off distance L from a workpiece 102. Atomized liquid or spray is focused at point P above the tool. Distance L may be adjusted so that a surface of workpiece 102 approximately coincides with focal point P. Thereby a type of local, controlled fluid deposition at a surface of the workpiece may be effected, or a specialized cleaning or rinse operation may be carried out. Those skilled in the art will readily recognize that a steady flow of fluid may be fed through bore segment 70 in a continuous sub-mode of the second mode of operation, and that alternatively, predetermined quantities of liquid may be dispensed into bowl 64 for atomization in a batch sub-mode of operation. In these applications, drain port 72 would ordinarily be plugged or otherwise closed to flow. A typical spray pattern developed is illustrated in FIG. 6 at Sp.

A parabaloid shape has been found to have special utility in the spray mode of operation of ultrasonic probes or tools 50, 50'. However, spherical or other shapes provide good results especially in standard ultrasonic cleaning applications, as exemplarily portrayed in FIG. 6.

Other embodiments of the principles described herein may be fashioned without straying from the basic principles of operation or concept. For example, an elongate ultrasonic tool with a cavity fillable through an integral bore may be provided with other, more complicated, cavity shapes, conforming to a particular configuration of electrical contacts or other objects to be cleaned; alternatively, cavities adapted especially for an atomizing function, and not a cleaning function, may be contemplated. The unique parabaloid focussing cavity shape may also find application where an extended tool is not required, so that a transducer may be mounted directly under the cavity in a more conventional manner.

These and many other variations and combinations of the novel principles expounded herein will occur to one skilled in the art. Accordingly the invention is not to be construed to be limited by the specific embodiments described by way of example, but by the useful discoveries in the ultrasonic art which they embody, and by the claims appended hereto.

What is claimed:

1. An ultrasonic probe comprising:

a shaft for transmitting ultrasonic mechanical vibrations from a source of ultrasonic vibrations; and a probe head at an end of said shaft, said probe head being provided on at least one lateral side with a recess, said shaft and said probe head having an absence of electrical circuit elements, said recess being an open container for holding an aliquot of liquid, said shaft having an axis and said probe head is wider than said shaft in at least one dimension oriented orthogonally to said axis.

2. The probe defined in claim 1 wherein said probe head is flattened in a dimension oriented perpendicularly to said one dimension.

3. The probe defined in claim 2 wherein said probe head has a substantially circular shape.

4. The probe defined in claim 2 wherein said recess is provided on a flattened side of said probe head.

5. An ultrasonic probe comprising:

a shaft for transmitting ultrasonic mechanical vibrations from a source of ultrasonic vibrations; and a probe head at an end of said shaft, said probe head being provided on at least one lateral side with a recess, said shaft and said probe head having an absence of electrical circuit elements, said recess being an open container for holding an aliquot of liquid, said probe head being provided with a channel communicating at one end with said recess.

6. The probe defined in claim 5 wherein said shaft has a longitudinal axis extending through said probe head and said recess, said recess being sufficiently deep to extend from one side to an opposite side of said axis, said channel extending through said shaft.

7. The probe defined in claim 6 wherein said probe head is provided with an additional channel communicating at one end with said recess.

8. The probe defined in claim 5 wherein said channel is a bore.

9. An ultrasonic probe comprising:

a shaft for transmitting ultrasonic mechanical vibrations from a source of ultrasonic vibrations; and a probe head at an end of said shaft, said probe head being provided on at least one lateral side with a recess, said shaft and said probe bead having an absence of electrical circuit elements, said recess being an open container for holding an aliquot of liquid, said recess being parabolic in cross section.

10. An ultrasonic probe comprising:

a shaft for transmitting ultrasonic mechanical vibrations from a source of ultrasonic vibrations;

a probe head at an end of said shaft, said probe head being provided on at least one lateral side with a recess, said shaft and said probe head having an absence of electrical circuit elements, said recess being an open container for holding an aliquot of liquid; and an elastic seal disposed on said probe bead and surrounding a mouth of said recess.

11. An ultrasonic probe comprising:

a shaft for transmitting ultrasonic mechanical vibrations from a source of ultrasonic vibrations, said shaft having a longitudinally extending channel for guiding liquid from a fluid source; and a probe head at an end of said shaft, said probe head being provided on at least one lateral side with an open recess communicating with said channel to enable a filling of said recess with liquid conducted through said channel.

12. The probe defined in claim 11 wherein said shaft has an axis and said probe head is wider than said shaft in at least one dimension oriented orthogonally to said axis.

13. The probe defined in claim 12 wherein said probe head is flattened in a dimension oriented perpendicularly to said one dimension.

14. The probe defined in claim 13 wherein said recess is provided on a flattened side of said probe head.

15. The probe defined in claim 11 wherein said shaft has an axis extending through said probe head and said recess, said recess being sufficiently deep to extend from one side to an opposite side of said axis.

16. The probe defined in claim 11 wherein said recess is parabolic in cross section.

17. The probe defined in claim 11, further comprising an elastic seal disposed on said probe head and surrounding a mouth of said recess.

18. An ultrasonic probe comprising:

a shaft for transmitting ultrasonic mechanical vibrations from a source of ultrasonic vibrations; and a probe head at an end of said shaft, said probe head being provided on at least one lateral side with a recess, said probe head being provided with a plurality of channels communicating with said recess.

19. The probe defined in claim 18, wherein said channels extend from opposing sides of said recess.

20. An ultrasonic probe comprising:

a shaft;

a threaded connector at one end of said shaft for connecting said shaft to a source of ultrasonic mechanical vibrations; and a probe head at an end of said shaft opposite said connector, said probe head being provided on at least one lateral side with an axially symmetric recess.

21. The probe defined in claim 20 wherein said recess is parabolic in cross section.

* * * * *